US006293877B1

(12) United States Patent
Boehm

(10) Patent No.: US 6,293,877 B1
(45) Date of Patent: Sep. 25, 2001

(54) GOLF BALL

(75) Inventor: Herbert C. Boehm, Norwell, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/221,848

(22) Filed: Dec. 29, 1998

(51) Int. Cl.[7] ..... A63B 37/04; A63B 37/06

(52) U.S. Cl. ..... 473/371; 473/361; 473/371; 473/365; 473/377; 473/378

(58) Field of Search ..... 473/361, 371, 473/365, 377, 378

(56) References Cited

U.S. PATENT DOCUMENTS

| | | | | |
|---|---|---|---|---|
| 697,925 | | 4/1902 | Kempshall . | |
| 698,516 | | 4/1902 | Kempshall . | |
| 700,658 | | 5/1902 | Kempshall . | |
| 701,741 | | 6/1902 | Kempshall . | |
| 704,748 | | 7/1902 | Kempshall . | |
| 704,838 | | 7/1902 | Kempshall . | |
| 711,508 | | 10/1902 | Kempshall . | |
| 720,852 | | 2/1903 | Smith, Jr. . | |
| 757,600 | | 4/1904 | Crawford . | |
| 780,582 | | 1/1905 | Richards . | |
| 790,252 | | 5/1905 | Du Mahaut . | |
| 1,255,388 | | 2/1918 | Cobb . | |
| 1,426,712 | | 8/1922 | Chatfield . | |
| 1,482,232 | | 1/1924 | Hazeltine . | |
| 1,524,171 | | 1/1925 | Chatfield . | |
| 1,553,386 | | 9/1925 | Kuhlke . | |
| 1,855,448 | | 4/1932 | Hazeltine . | |
| 2,055,326 | | 9/1936 | Young . | |
| 2,181,350 | | 11/1939 | Smith . | |
| 2,307,182 | | 1/1943 | Young . | |
| 2,364,955 | | 12/1944 | Diddel . | |
| 3,256,019 | | 6/1966 | Barton . | |
| 3,738,655 | | 6/1973 | Feddick et al. . | |
| 4,203,941 | | 5/1980 | Brooker . | |
| 4,804,189 | | 2/1989 | Gobush . | |
| 4,830,378 | | 5/1989 | Aoyama . | |
| 5,020,803 | * | 6/1991 | Gendreau | 273/225 |
| 5,421,580 | * | 6/1995 | Sugimoto | 273/227 |
| 5,480,143 | | 1/1996 | McMurry . | |
| 5,688,191 | * | 11/1997 | Cavallaro | 473/373 |
| 5,759,676 | * | 6/1998 | Cavallaro | 428/215 |
| 5,779,561 | * | 7/1998 | Sullivan | 473/373 |
| 5,779,562 | * | 7/1998 | Melvin | 473/373 |
| 5,810,678 | * | 9/1998 | Cavallaro | 473/373 |
| 5,813,923 | * | 9/1998 | Cavallaro | 473/373 |
| 5,820,485 | | 10/1998 | Hwang . | |
| 5,830,086 | * | 11/1998 | Hayashi | 473/376 |
| 5,984,807 | | 11/1999 | Wai et al. | 473/376 |

FOREIGN PATENT DOCUMENTS

| | | |
|---|---|---|
| 2 162 072 | 1/1986 | (GB) . |

* cited by examiner

*Primary Examiner*—Lee Young
*Assistant Examiner*—Paul D Kim
(74) *Attorney, Agent, or Firm*—Pennie & Edmonds LLP

(57) ABSTRACT

The present invention is directed towards a golf ball which comprises a core; at least one cover layer; at least one mantle layer disposed between the core and the cover; and at least one transition layer disposed between two of the other layers of the golf ball comprised of discrete portions of at least one of the adjacent layers. The transition layer may be formed by projections extending from one layer and cavities on the opposing layer for interlocking with the projections. The thickness of a first layer is X and the thickness of a second layer is Y and the thickness of the transition layer is Z. The Flexural Modulus of the first layer is $E_x$ and the second layer is $E_y$. In the golf ball according to the present invention, Z is determined by the following formula:

$$\frac{X+Y}{4} \leq Z \leq 1.5(X+Y) \quad \text{and}$$

$$\frac{E_x}{E_y} \leq 0.9 \quad \text{OR} \quad \frac{E_x}{E_y} \geq 1.1.$$

14 Claims, 4 Drawing Sheets

GOLF BALL

FIELD OF THE INVENTION

This invention relates generally to golf balls, and more specifically, to a multilayer golf ball. In particular, this invention relates to a golf ball having a core, a cover and one or more mantle layers disposed between the core and the cover. This invention is also directed to a golf ball where at least one layer is a transition layer that has non-uniform material properties. Specifically, the transition layer is made of the materials of the immediately adjacent layers to the transition layer. This allows the creation of multiple layers with fewer different materials.

BACKGROUND OF THE INVENTION

Conventional golf balls can be divided into two general types of groups: two piece balls or wound balls (also known as three piece balls). The difference in play characteristics resulting from these different types of construction can be quite significant.

Balls having a two piece construction are generally most popular with the average recreational golfer because they provide a very durable ball while also providing maximum distance. Two piece balls are made with a single solid core usually made of a cross linked rubber, which is enclosed by a cover material. Typically the solid core is made of polybutadiene which is chemically crosslinked with zinc diacrylate and/or similar crosslinking agents and is covered by a tough, cut-proof blended cover. The cover is generally a material such as SURLYN®, which is a trademark for an ionomer resin produced by DuPont. The combination of the core and cover materials provide a "hard" ball that is virtually indestructible by golfers. Further, such a combination imparts a high initial velocity to the ball which results in improved distance. Because these materials are very rigid, two piece balls have a hard "feel" when struck with a club. Likewise, due to their hardness, these balls have a relatively low spin rate which provides greater distance.

At the present time, the wound ball remains the preferred ball of the more advanced player due to its spin and feel characteristics. Wound balls typically have either a solid rubber or liquid center core around which many yards of a stretched elastic thread are wound. The wound core is then covered with a durable cover material such as a SURLYN® or similar material or a softer cover such as Balata or polyurethane. Wound balls are generally softer and provide more spin, which enables a skilled golfer to have more control over the ball's flight and position. Particularly, with approach shots onto the green, the high spin rate of soft, wound balls enables the golfer to stop the ball very near its landing position.

Regardless of the form of the ball, players generally seek a golf ball that delivers maximum distance, which requires a high initial velocity upon impact. Therefore, in an effort to meet the demands of the marketplace, manufacturers strive to produce golf balls with initial velocities that approximate the maximum allowed by the USGA as closely as possible. Thus, golf ball manufacturers are continually searching for new ways in which to provide golf balls that deliver the maximum performance for golfers of all skill levels.

There are many prior art patents revealing balls with multi-layer constructions. However, in most of these patents each new layer is described as a uniquely spherical shell with an inner and outer radius from the center of the ball and uniform material properties within the layer. Thus, each layer is uniform in both its radius and in the materials with which it is constructed.

Other patents teach various constructions, however none teach the present invention. For example, U.S. Pat. Nos. 698,516 and 701,741 to Kempshall describe a golf ball formed with hemispherical plastic segments having indentations or perforations on their outer surface. A celluloid is spread over the surface and enters the indentations or perforations forming teeth or hobs all over the ball. A segment with an inner fabric is then placed over the ball and is compressed so that the celluloid becomes embedded in the fabric. This construction requires the use of additional materials including the fabric and the celluloid. Further, the ball is more difficult to construct.

U.S. Pat. No. 790,252 to Mahaut describes a construction of an intermediate layer made of a rubber composition with the outer surface formed of a succession of resilient projections in the form of knobs. The knobs however are compressed by the outer jacket of a smooth cylindrical shape. The advantage of a solid transition layer made of two adjacent layers is not realized.

U.S. Pat. No. 1,855,448 to Hazeltine discloses a golf ball having a mesh work placed over the core of the ball, and a cover is molded over the mesh work. This construction requires the use of additional materials including the mesh work.

U.S. Pat. No. 2,364,955 to Diddel discloses a golf ball having a core with cylindrical bores, a rod like material is placed within the bores and the ball is covered. This construction also uses additional materials, including the material placed in the bores and does not form the transition layer from two adjacent layers.

Therefore, it would be advantageous to provide a golf ball with at least one layer that was not uniform in radius and/or materials, which would allow three layers to be created with only two different materials and two different process steps. The present invention provides such a layer within a golf ball.

SUMMARY OF THE INVENTION

The present invention is directed to a multilayer golf ball that includes at least one transition layer that has non-uniform material properties so that fewer different materials and processing steps need be used to manufacture the golf ball. Moreover, the golf ball designer has an extra layer of material for unique performance properties when the ball is struck at different clubhead speeds. Generally, the prior art has been directed to making golf balls with spherical layers with an inner and outer radius, where the layers have uniform material properties. The present golf ball is directed to a golf ball that includes at least one layer with non-uniform material properties. A discrete portion in at least one layer includes the same materials as at least one of the immediately adjacent layers.

The present invention is further directed to a multilayer golf ball which comprises a core with one or more layers; at least one cover layer; and one or more mantle layers disposed between the core and the cover layer. At least one of the layers is preferably a transition layer in which discrete portions of the transition layer are the same material composition as the immediately adjacent layers on either side of the transition layer.

The present invention is still further directed to a multilayer golf ball which comprises a core, at least one cover layer and at least one mantle layer disposed between the core and the cover layer wherein a transition layer is located between the cover and mantle layers. Discrete portions of the transition layer are made of the material of the cover or mantle layer resulting in the layer having non-uniform material properties.

The present invention is more particularly directed to a transition layer as stated above, wherein the transition layer is formed with a sufficient thickness to accomplish the golf ball designers goal of altering the playing characteristics of the ball. Moreover, the material properties of the materials forming the transition are preferably selected such that the transition layer can be changed by changing the percentage of each of the materials forming the layer.

The present invention is also directed to an improved multilayer golf ball which comprises a core, at least one cover layer and at least one mantle layer disposed between the core and the cover layer The cover has an inside surface that includes protrusions extending inwardly. The mantle layer includes an exterior surface with interlocking cavities to receive the protrusions of the cover, thereby forming a transition layer with non-uniform material properties.

The present invention is also directed to an improved multilayer golf ball which comprises a core, at least one cover layer and at least one mantle layer disposed between the core and a cover layer. A transition layer is located between the cover and the mantle layer. The mantle layer has an outside surface that includes protrusions extending outwardly. The cover includes an interior surface with interlocking cavities to receive the protrusions of the mantle layer, thereby forming a transition layer with non-uniform material properties.

The protrusions on either the mantle layer or the cover may be of a variety of shapes includes hemispheres, circles, triangles, conical shapes and various other polyhedrons. These may be extended into smaller circles, triangles, cones, or polyhedrons. Further, these projections may also be cut flat on the top of the projection so that they do not come to a point. The protrusions may be of a uniform size, shape and pattern, or they may be varied in size, shape, and/or pattern.

DETAILED DESCRIPTION OF THE PREFERRED EMBODIMENTS

The following terms that are used in this application are defined in terms of the enumerated ASTM tests:

| | |
|---|---|
| Flexural (Flex) Modulus | ASTM D-790 |
| Shore D Hardness | ASTM D-2240 |

As used herein, the terms "points or compression points" refer to the compression scale or the compression scale based on the ATTI Engineering Compression Tester. This scale, which is well known to those working in this field, is used in determining the relative compression of a core or ball. Some artisans use the Reihle compression scale instead of the standard compression scale. Based on disclosure in U.S. Pat. No. 5,368,301, column 20 lines 55–53, it appears that Reihle compression values can be converted to compression values through the use of the following equation:

compression value=160−Reihle compression value.

Figure 1:
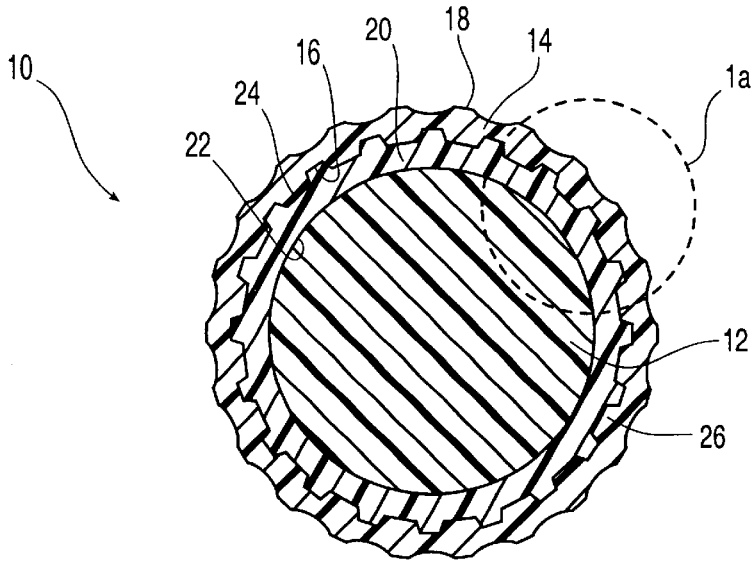
FIG. 1 is a cross-sectional view of a golf ball according to the present invention.

Referring to FIG. 1, this invention is directed to a multilayer golf ball 10 which comprises a core 12, at least one cover layer 14 with an inner cover surface 16 and an outer cover surface 18, at least one mantle layer 20 disposed therebetween with an inner mantle surface 22 and an outer mantle surface 24, and at least one transition layer 26 disposed between the cover 14 and the mantle layer 20.

Figure 1A:
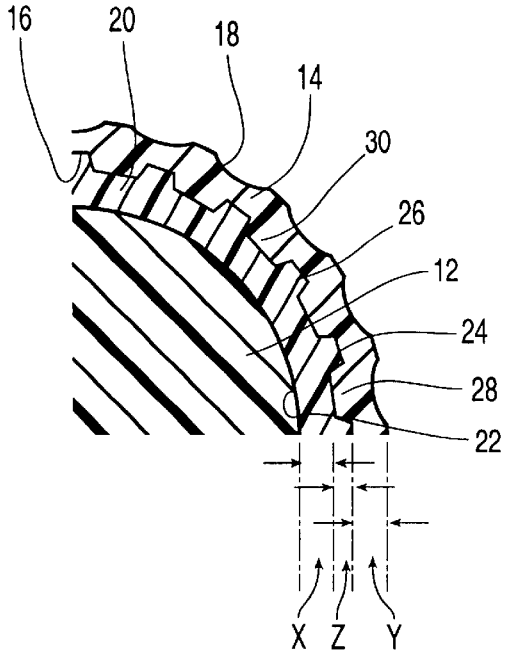
FIG. 1*a* is a detail of the cross-sectional view of the transition layer of the present invention.
Figure 1B:
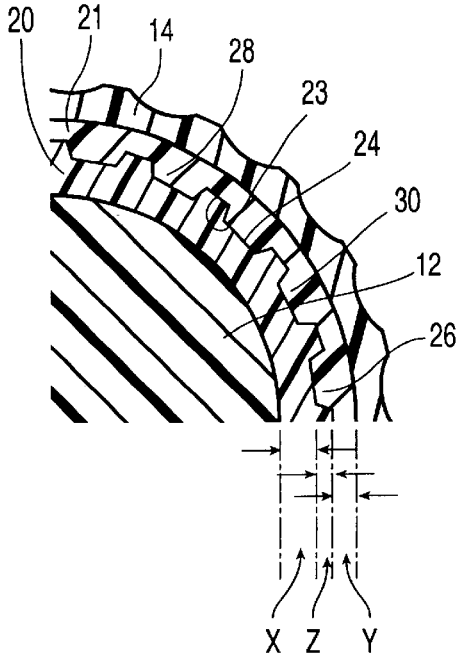
FIG. 1*b* is a detail of the cross-sectional view of a second embodiment of the transition layer of the present invention.
Figure 2:
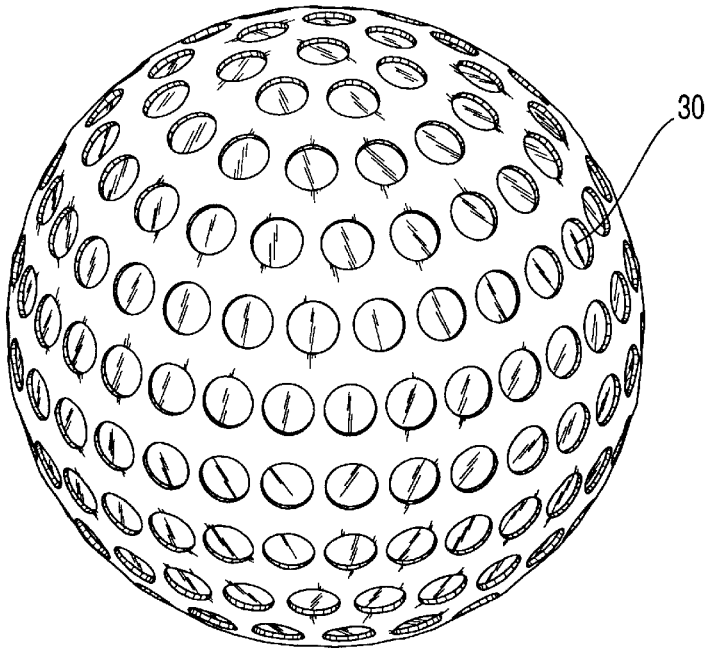
FIG. 2 is a perspective view of half of the transition layer on the mantle layer according to the present invention.

The transition layer 26 is formed by interlocking sections of two adjacent layers. As shown in FIG. 1*a*, sections of the cover 14 interlock with sections of the mantle layer 20 to form the transition layer 26. Specifically, the cover 14 and mantle layer 20 are not perfectly spherical. Protrusions 28 on the inner cover surface 16 of the cover interlock with cavities 30 on the outer mantle surface 24 of the mantle layer 20. FIG. 1*b* shows a golf ball with a core 12, a cover 14 and first and second mantle layers 20, 21 disposed therebetween. A transition layer 26 is disposed between the two mantle layers 20, 21. Protrusions 28 on an inner surface 23 of the second mantle layer 21 interlock with cavities 30 on an outer surface 24 of the first mantle layer 20. As shown in FIG. 2, these protrusions 28 and cavities 30 are preferably symmetrical protrusions/apertures and are positioned around the ball like a dimple pattern.

Figure 3:
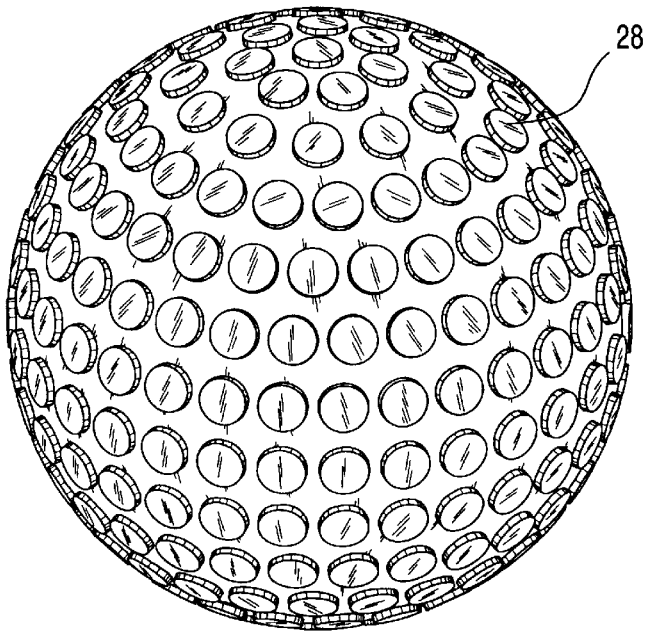
FIG. 3 is a perspective of half of the transition layer on the mantle layer according to the present invention.

As shown in FIG. 3, the protrusions 28 may be on the outer surface of the mantle layer 24. These protrusions 28 may interlock with cavities 30 located on the inner surface of the cover 16. Furthermore, it will be understood that the protrusions 28 may be placed on any surface of any layer of the golf ball and they may interlock with matching cavities 30 on an adjacent surface to form a transition layer 26. Further, multiple covers and/or mantle layers 20 can be included in the golf ball 10, and multiple transition layers 26 can be located between these layers.

As shown in FIG. 1*a*, the mantle layer 20 has a thickness X, the cover 14 has a thickness Y, and the transition layer 26 has a thickness Z. Also, as shown in FIG. 1*b*, the first mantle layer has a thickness X, the second mantle layer has a thickness Y, and the transition layer 26 has a thickness Z. Preferably, the thickness of transition layer Z is determined by the following formula:

$$\frac{X+Y}{4} \leq Z \leq 1.5(X+Y)$$

More preferably, the thickness of the transition layer Z is determined by the following formula:

$$\frac{X+Y}{2} \leq Z \leq 1.5(X+Y)$$

And, preferably, a Flexural Modulus of the mantle layer $E_x$ and the cover $E_y$ do not exceed values in relation to each other expressed by the following formula:

$$\frac{E_x}{E_y} \leq 0.9 \quad \text{OR} \quad \frac{E_x}{E_y} \geq 1.1$$

More preferably, the Flexural Modulus of the mantle layer $E_x$ and the cover $E_y$ do not exceed values in relation to each other expressed by the following formula:

$$\frac{E_x}{E_y} \leq 0.8 \quad \text{OR} \quad \frac{E_x}{E_y} \geq 1.2$$

As used in the present invention, X is generally about 0.02 to 0.08 inches and Y is generally about 0.02 to 0.08 inches. Preferably X is 0.025 to 0.045 inches and Y is 0.025 to 0.045 inches. Also, the Flexural Modulus of either the cover 14, $E_y$, or the mantle layer 20, $E_x$, is from about 3,000 to 80,000 psi. The Shore D hardness of the materials for either the cover 14 or mantle layer 20 is preferably about 30 to 75 Shore D.

Preferably, the golf ball according to the present invention has core 12 with a diameter between 1.3 and 1.58 inches with a ATTI compression between 40 and 95. The core can be a wound core having a solid or liquid filled center or a solid core having one or more layers comprised of a rubber based material such as polybutadiene based rubber compositions or thermoplastic elastomeric materials of appropriate resiliency.

Preferably, the cover 14 is formed of a thermoplastic material such as an ionomer resin or a castable material including a polyurethane such as those disclosed in U.S. Pat. No. 5,334,673, which is incorporated by reference herein.

The mantle layer 20 is preferably formed of a thermoplastic material such as those disclosed in U.S. Pat. No. 5,688,191, which is incorporated by reference herein, or an ionomer resin.

The average physical properties of the transition layer 26 are intermediate to the physical properties of the mantle layer 20 and the cover 14. Thus, the construction of the transition layer 26 can be altered to achieve desired physical properties which will in turn affect the flight of the golf ball 10. The construction is altered by varying the volume of each adjacent layer that forms part of the transition layer 26. Further, the shape, size and pattern of the projections 28 are alterable to affect the percentage of the transition layer that is made from each of the adjoining layers to alter the playing characteristics of the golf ball 10. The projections also assist in efficiently transferring energy from the cover of the golf ball when the ball is struck by a club head to the core of the golf ball. The transition layer volume is preferably comprised of 20–80% of the mantle layer 20 and 80–20% of the cover 14.

Figure 4:
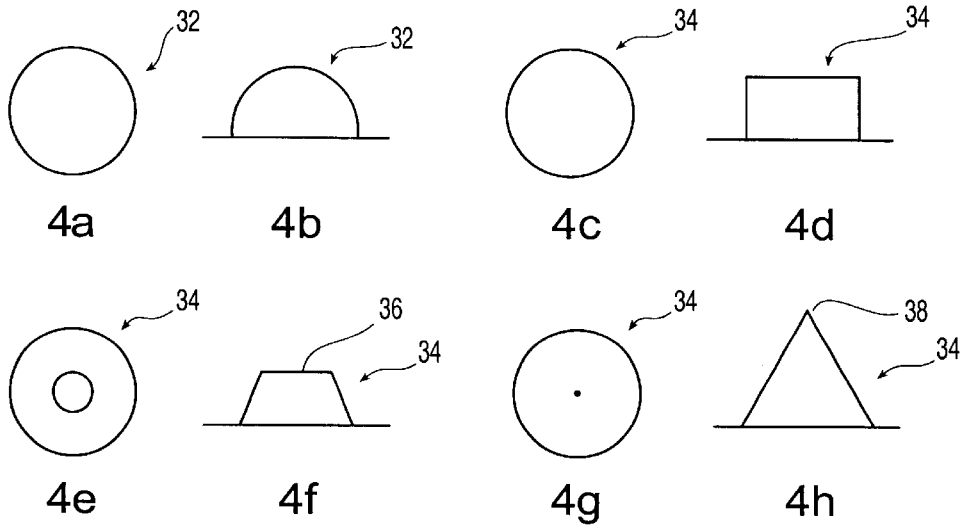
FIG. 4*a–h* are top and side views of various projections usable with the present invention.

As shown in FIGS. 4*a–h* and 5*a–l* the projections 28 can be made in a variety of shapes. Specifically, FIG. 4*a–b* shows a hemispherical shaped projection 32 from a top and side view, 4*c–g* shows a projection shaped as a circle 34. The projection extends into a circle of the same diameter with a flat top, as shown in FIGS. 4*c–d*, or extends into a circle with a smaller diameter 36, as shown in FIGS. 4*e–f*, or extends in a conical shape to a point 38, as shown in FIGS. 4*g–h*.

FIGS. 5*a–l* also show a variety of other shapes from both a top and side view. FIGS. 5*a–d* show triangular shaped projections 40 that extend to the same size triangle or extend into a smaller sized triangle 42. FIGS. 5*e–h* show square shaped projections 44 that extend into the same size square or extend into a smaller sized square 46. Finally, FIGS. 5*i–l* show another polygonal shaped projection 48 having five sides. The polygon projection 48 either extends into the same sized shape or extends into a smaller sized shape polygon 50. The cavities 30 on the opposing surface of all of these shapes are formed to interlock with the respective projection 28 so that the projection 28 and cavity 30 mate with each other to form the transition layer 26.

Figure 5:
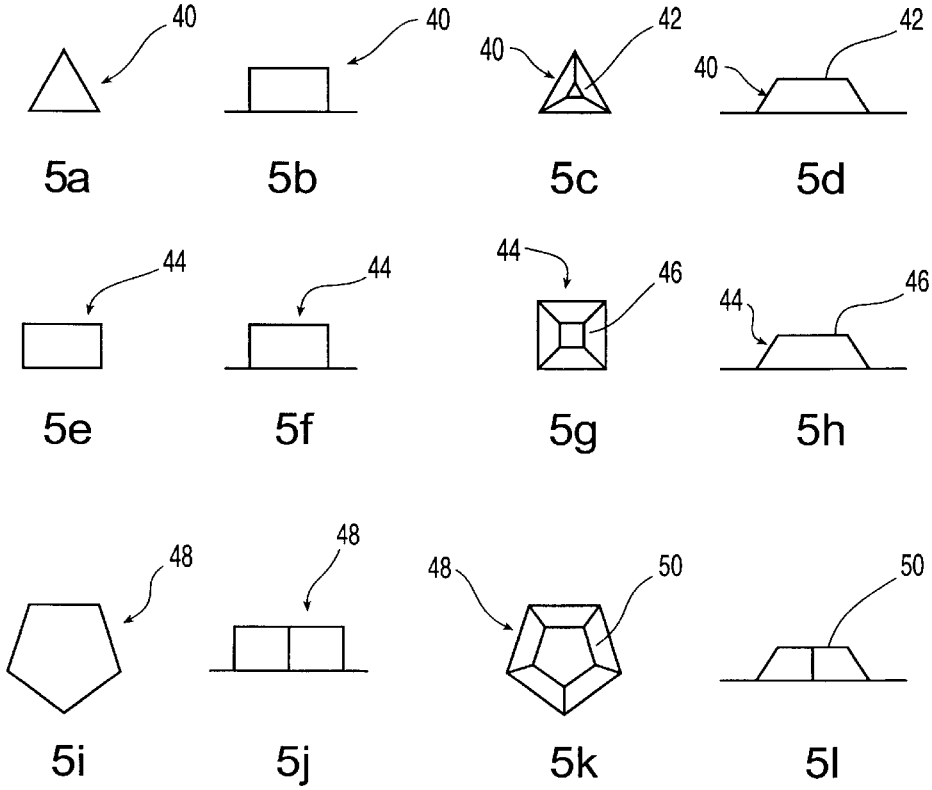
FIG. 5*a–l* are top and side views of various projections usable with the present invention.

As shown, for example, in FIGS. 5*a–b*, the percentage of the first material is constant through the thickness of the transition layer. Thus, the area of the material is equal on both sides of the transition layer. However, the percentage of the first material can also be varied within the transition layer. For example, as shown in FIGS. 5*c–d*, the percentage of the first material varies through the thickness of the transition layer. The percentage may vary linearly with respect to the radius of the projection or the percentage may vary by other methods. Thus, the shape of the projection can be changed to result in a constant percentage of the first material or a varied percentage of the first material through the transition later.

Figure 6:
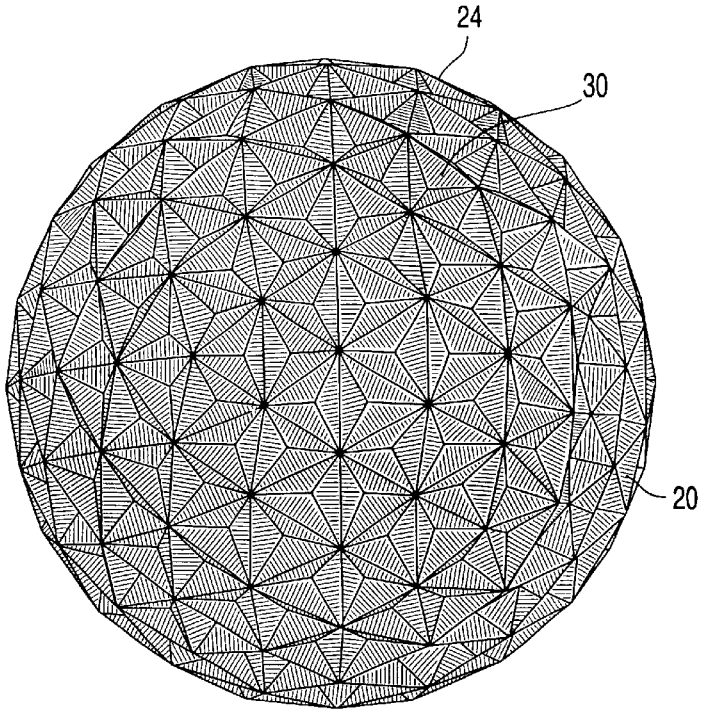
FIG. 6 is a perspective of half of the transition layer on the mantle layer according to the present invention.
Figure 7:
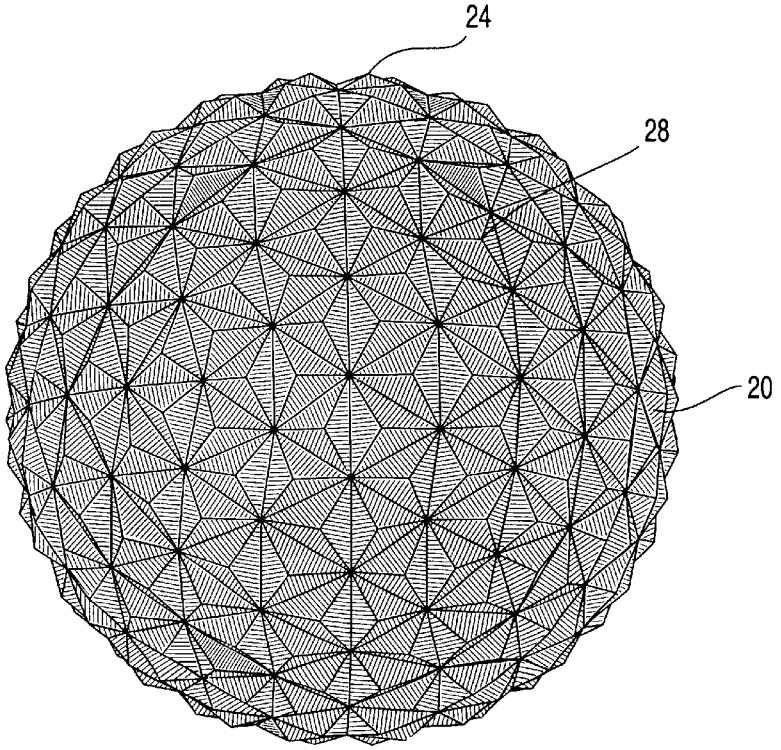
FIG. 7 is a perspective of half of the transition layer on the mantle layer according to the present invention.

It will be recognized that numerous other shapes than those described can be used for the projections. Further, the number, size, shape, and pattern of the projections can be modified to achieve the desired golf ball characteristics. Examples of such modifications are shown in FIGS. 6–7, which show two patterns using triangular apertures 30 and projections 28 molded on the outer surface 24 of the mantle layer 20. These apertures or projections will be covered by a cover molded onto the mantle layer surface to form mating triangular projections or apertures.

The golf balls of the present invention can be made by any conventional process employed in the golf ball art. For example, the solid cores 12 can be either injection or compression molded. Similarly, wound cores 12 are produced through conventional means. Preferably, the mantle layer 20 is subsequently injection molded about the core 12. It is important that the mantle material be able to sustain the temperatures applied during the application of the cover layer 14. The desired projections 28 or cavities 30 of the transition layer 26 are formed on the outer mantle surface 24 of the mantle layer 20 during molding. The cover layer or layers 14 are then injection or compression molded or cast about the mantle layer 20. Thus, the transition layer 26 is completed by forming the matching interlocking projections 28 or cavities 30 while molding the cover.

More than one transition layer 26 can be included in the golf ball 10. Thus, a transition layer 26 could be included both between the core 12 and the mantle layer 20 and the mantle layer 20 and the cover 14. Or multiple cover 14 or mantle layers 20 maybe used in the construction of the golf ball 10. Thus, a transition layer 26 can be formed between adjacent mantle layers 20, between the mantle layer 20 and cover 14, and/or between covers 14.

These and other aspects of the present invention may be more fully understood with reference to the following non-limiting examples, which are merely illustrative of the preferred embodiment of the present invention golf ball construction, and are not to be construed as limiting the invention, the scope of which is defined by the appended claims.

EXAMPLE 1

A golf ball according to the present invention has a solid polybutadiene composition core with a ATTI compression in the range of 40–95, a cover and a mantle layer therebetween. The mantle layer and cover are formed such that a transition layer is formed between the cover and the mantle layer. The transition layer is formed of discrete portions of both the mantle layer and the cover materials. The mantle layer is formed by injection molding a standard SURLYN such as 7940 with a thickness X of 0.025. The cover is formed by casting a polyurethane such as that disclosed in U.S. Pat. No. 5,334,673 with a thickness Y of 0.025. The mantle layer has a Shore D hardness of about 67 and a Flexural Modulus $E_x$ of about 62,000 psi. The cover has a Shore D hardness of about 57 and a Flexural Modulus $E_y$ of about 25,000 psi. The transition layer is made of about 50% mantle layer and 50% cover material by forming protrusions as shown in FIG. 4*e–f* on the cover inner surface and corresponding apertures in the outer surface of the mantle layer. According the formula described previously, the thickness Z of the transition layer is as follows:

$$\frac{0.025+0.025}{4} \le Z \le 1.5(0.025+0.025)$$

Thus, Z has a value of:

$0.0125 \leqq Z \leqq 0.075$

Most preferably, the transition layer 26 has a thickness Z of about 0.05. Most preferably, the core diameter is 1.48 inches, and the golf ball diameter is 1.68 inches. Furthermore, the flexural modulus of the cover $E_y$ and mantle layer $E_x$ fall within the desired values for the formula:

$$\frac{E_x}{E_y} = \frac{62{,}000}{25{,}000} = 2.5$$

$$\text{Thus, } \frac{E_x}{E_y} \ge 1.1.$$

EXAMPLE 2

A golf ball according to the present invention has a solid polybutadiene composition core, a cover and a mantle layer therebetween. The mantle layer and cover are formed such that a transition layer is formed between the cover and the mantle layer. The transition layer is formed of discrete portions of both the mantle layer and the cover materials. The mantle layer is formed by injection molding a standard SURLYN such as 7940 with a thickness X of 0.025. The cover is formed by injection molding a blend of standard SURLYN, such as 7940, and low modulus SURLYN, such as 8320 with a thickness Y of 0.025. The mantle layer has a Shore D hardness of about 67 and a Flexural Modulus $E_x$ of about 62,000 psi. The cover is preferably a blend of about 70% standard SURLYN with about 30% low modulus SURLYN so that it has a Shore D hardness of about 62 and a Flexural Modulus $E_y$ of about 40,000 psi. The transition layer is made of about 50% mantle layer and 50% cover materials by forming protrusions such those shown in FIGS. 4*e–f* on the outer surface of the mantle layer and corresponding apertures in the cover inner surface. According the formula described previously, the thickness Z of the transition layer is as follows:

$$\frac{0.025+0.025}{4} \le Z \le 1.5(0.025+0.025)$$

Thus, Z has a value of:

$0.0125 \leqq Z \leqq 0.075$

Most preferably, the transition layer 26 has a thickness Z of about 0.05. Most preferably, the core diameter is 1.48 inches and the golf ball diameter is 1.68 inches. Furthermore, the flexural modulus of the cover $E_y$ and mantle layer $E_x$ fall within the desired values for the formula:

$$\frac{E_x}{E_y} = \frac{62{,}000}{40{,}000} = 1.6$$

$$\text{Thus, } \frac{E_x}{E_y} \ge 1.1.$$

EXAMPLE 3

A golf ball according to the present invention has a solid polybutadiene composition core, a cover and a mantle layer therebetween. The mantle layer and cover are formed such that a transition layer is formed between the cover and the mantle layer. The transition layer is formed of discrete portions of both the mantle layer and the cover materials. The mantle layer is formed by injection molding a blend of standard ionomer such as SURLYN 7940 with a low modulus ionomer such as SURLYN 8320 with a thickness X of 0.025. The cover is formed by injection molding a standard ionomer, such as SURLYN 7940, with a thickness Y of 0.025. The mantle is preferably a blend of about 70% standard ionomer with about 30% low modulus ionomer so that it has a Shore D hardness of about 62 and a Flexural Modulus Ex of about 40,000 psi. The cover preferably has a Shore D hardness of about 67 and a Flexural Modulus $E_y$ of about 62,000 psi. The transition layer is made of 50% mantle layer and 50% cover material. According the formula described previously, the thickness Z of the transition layer is as follows:

$$\frac{0.025+0.025}{4} \le Z \le 1.5(0.025+0.025)$$

Thus, Z has a value of:

$0.0125 \leqq Z \leqq 0.075$

Most preferably, the transition layer 26 has a thickness Z of about 0.05. Most preferably, the core diameter is 1.48 inches, and the golf ball diameter is 1.68 inches. Furthermore, the flexural modulus of the cover $E_y$ and mantle layer $E_x$ fall within the desired values for the formula:

$$\frac{E_x}{E_y} = \frac{40{,}000}{62{,}000} = 0.6$$

$$\text{Thus, } \frac{E_x}{E_y} \le 0.9.$$

EXAMPLE 4

A golf ball according to the present invention has a core and a cover with a mantle layer therebetween and a transition layer located between the cover and the mantle layer. The core is a wound core with a corn syrup and water liquid center covered by a thermoplastic shell and further covered with elastomeric windings. The transition layer is formed of discrete portions of both the mantle layer and the cover materials. The mantle layer is formed by injection molding a thermoplastic polyesterester such as HYTREL 3078 and has a thickness X of 0.035. The cover is formed by injection molding a standard ionomer, such as SURLYN 7940 and has a thickness Y of 0.035. The mantle layer has a Shore D hardness of about 30 and a Flexural Modulus $E_x$ of about 3,000 psi. The cover has a Shore D hardness of about 67 and a Flexural Modulus $E_y$ of about 62,000 psi. The transition layer is made of 30% mantle layer and 70% cover materials using protrusions such as those set forth in FIGS. 5*k–L* on the inner surface of the cover layer and corresponding cavities on the outer surface of the mantle layer. According the formula discussed above, the thickness Z of the transition layer is as follows:

$$\frac{0.035+0.035}{4} \leq Z \leq 1.5(0.035+0.035)$$

Thus, Z has a value of:

$0.0175 \leqq Z \leqq 0.105$

Most preferably, the transition layer 26 has a thickness Z of about 0.035. Most preferably, the core diameter is 1.51 inches, and the golf ball diameter is 1.72 inches. Furthermore, the flexural modulus of the cover $E_y$ and mantle layer $E_x$ fall within the desired values for the formula:

$$\frac{E_x}{E_y} = \frac{3{,}000}{62{,}000} = 0.05$$

$$\text{Thus, } \frac{E_x}{E_y} \leq 0.9.$$

EXAMPLE 5

A golf ball according to the present invention has a core, a cover, a mantle layer therebetween and a transition layer located between the cover and the mantle layer. The transition layer is formed of discrete portions of both the mantle layer and the cover materials. The mantle layer has a thickness X of 0.035 and the cover has a thickness Y of 0.035. The mantle layer is preferably formed of a standard ionomer such as SURLYN 7940 and has a Shore D hardness of about 67 and a Flexural Modulus $E_x$ of about 62,000 psi. The cover is preferably formed of a blend of about 70% of a standard ionomer such as SURLYN 7940 and about 30% of a low modulus ionomer such as SURLYN 8320 and has a Shore D hardness of about 62 and a Flexural Modulus $E_y$ of about 40,000 psi. The transition layer is made of about 60% mantle layer and 40% cover materials. According the formula discussed above, the thickness Z of the transition layer is as follows:

$$\frac{0.035+0.035}{4} \leq Z \leq 1.5(0.035+0.035)$$

Thus, Z has a value of:

$0.0175 \leqq Z \leqq 0.105$

Most preferably, the transition layer 26 has a thickness Z of about 0.035. Most preferably, the core diameter is 1.47 inches and the golf ball diameter is 1.68 inches. Furthermore, the flexural modulus of the cover $E_y$ and mantle layer $E_x$ fall within the desired values for the formula:

$$\frac{E_x}{E_y} = \frac{62{,}000}{40{,}000} = 1.6$$

$$\text{Thus, } \frac{E_x}{E_y} \geq 1.1.$$

While it is apparent that the illustrative embodiments of the invention herein disclosed fulfills the objectives stated above, it will be appreciated that numerous modifications and other embodiments may be devised by those skilled in the art. For example, multiple cover layers can be included in the golf ball and at least one transition layer can be formed between two of the cover layers. Or, the transition layer can be located between the core and the adjacent mantle layer of the golf ball. Therefore, it will be understood that the appended claims are intended to cover all such modifications and embodiments which come within the spirit and scope of the present invention.

What is claimed is:

1. A golf ball comprising:

a core;

at least one first layer, the first layer being formed of a first material having a flexural modules $E_y$ and having a thickness Y;

at least one second layer disposed between the core and the first layer being formed of a second material having a flexural modules $E_x$ and having a thickness X; and at least one transition layer disposed between the first and second layers formed of interlocking discrete portions of the first and second materials;

wherein the transition layer has a thickness Z determined by the following formula:

$$\frac{X+Y}{4} \leq Z \leq 1.5(X+Y) \quad \text{and}$$

$$\frac{E_x}{E_y} \leq 0.9 \quad \text{OR} \quad \frac{E_x}{E_y} \geq 1.1.$$

2. A golf ball comprising:

a core;

at least one cover, the cover being formed of a first material having a flexural modules $E_y$ and having a thickness Y;

at least one mantle layer disposed between the core and the cover layer being formed of a second material having a flexural modules $E_x$ and having a thickness X; and at least one transition layer disposed between the cover and the mantle layer formed of interlocking discrete portions of the first and second materials;

wherein the transition layer has a thickness Z determined by the following formula:

$$\frac{X+Y}{4} \leq Z \leq 1.5(X+Y) \quad \text{and}$$

$$\frac{E_x}{E_y} \leq 0.9 \quad \text{OR} \quad \frac{E_x}{E_y} \geq 1.1.$$

3. The golf ball of claim 1 or 2, wherein the transition layer has a thickness Z determined by the following formula:

$$\frac{X+Y}{2} \leq Z \leq 1.5(X+Y).$$

4. The golf ball of claim 1 or 2, wherein:

$$\frac{E_x}{E_y} \leq 0.8 \quad \text{OR} \quad \frac{E_x}{E_y} \geq 1.2.$$

5. The golf ball of claim 4 wherein the transition layer has a thickness Z determined by the following formula:

$$\frac{X+Y}{2} \leq Z \leq 1.5(X+Y).$$

6. The golf ball of claim 1 or 2 wherein $E_y$ and $E_x$ are at least 3000 psi.

7. The golf ball of claim 1 or 2 wherein the first and second materials have a Shore D hardness of at least 30.

8. The golf ball of claim 1 or 2 wherein:

X is less than about 0.08 inches; and

Y is less than about 0.08 inches.

9. The golf ball of claim 1 or 2 wherein:

the transition layer is comprised of between 20% and 80% of the first material.

10. The golf ball of claim 1 or 2 wherein the core is a wound core.

11. The golf ball of claim 1 or 2 wherein the core is a solid core.

12. The golf ball of claim 1 or 2 wherein the golf ball has a diameter of about 1.68 to 1.75 inches.

13. The golf ball of claim 1 or 2 wherein a percentage of the first material included through the transition layer is constant.

14. The golf ball of claim 1 or 2 wherein a percentage of the first material included through the transition layer is varied.

* * * * *